US006038732A

United States Patent [19]

McKnight et al.

[11] Patent Number: 6,038,732

[45] Date of Patent: Mar. 21, 2000

[54] VACUUM CLEANER NOZZLE ADAPTER

[75] Inventors: Darwin T. McKnight, Louisville; John D. Essex, North Canton; Kenneth L. Symensma, Canton, all of Ohio

[73] Assignee: The Hoover Company, North Canton, Ohio

[21] Appl. No.: 09/046,893

[22] Filed: Mar. 24, 1998

Related U.S. Application Data

[63] Continuation of application No. 08/502,128, Jul. 13, 1995, abandoned.

[51] Int. Cl.[7] ..... A47L 9/02

[52] U.S. Cl. ..... 15/414; 15/321; 15/322; 15/420

[58] Field of Search ..... 15/320, 321, 322, 15/414, 415.1, 416, 417, 420

[56] References Cited

U.S. PATENT DOCUMENTS

| | | | |
|---|---|---|---|
| 1,033,195 | 7/1912 | Robinson . | |
| 2,509,604 | 5/1950 | McGregor . | |
| 2,597,966 | 5/1952 | Adler . | |
| 3,085,267 | 4/1963 | Jacuzzi . | |
| 4,606,092 | 8/1986 | Henning | 15/420 |
| 5,001,806 | 3/1991 | Gurstein | 14/414 |
| 5,535,478 | 7/1996 | Thompson | 15/401 |

FOREIGN PATENT DOCUMENTS

| | | | |
|---|---|---|---|
| 2704308 | 8/1978 | Germany | 15/322 |

OTHER PUBLICATIONS

"Hoover® Duby–Duty™ Wet & Dry Cleaner Owner's manual, see pages 4 (item G) and 6, copyright and production of product in 1987".

*Primary Examiner*—William H. Beisner

*Attorney, Agent, or Firm*—A. Burgess Lowe; Bruce P. Watson

[57] ABSTRACT

A removable suction nozzle inlet adapter is taught for converting the suction inlet of a vacuuming nozzle from a straight line inlet to one having either a convex or concave suction inlet whereby curved carpet and/or upholstery surfaces may be vacuumed. The adapters are particularly useful for use with hand held hot water extractor nozzles upon the curved carpet surface between the step and risers of carpeted stairs and/or the curved carpet transition from the riser to the horizontal step. Further, the invention described and taught may be used to vacuum curved upholstery or carpet surfaces found in the typical household and/or automobile.

14 Claims, 11 Drawing Sheets

VACUUM CLEANER NOZZLE ADAPTER

RELATED APPLICATIONS

This application is a continuation of copending U.S. patent application Ser. No. 08/502,128 filed on Jul. 13, 1995, now abandoned.

BACKGROUND OF THE INVENTION

The herein described invention relates to vacuum cleaner accessories particularly for hand held vacuum nozzles commonly used with carpet/upholstery extractors.

Heretofore carpeted stairs have been vacuumed and/or deep cleaned by hot water extraction techniques using a relatively small hand held suction nozzle of approximately four to five inches in width. The nozzle is typically connected, by a flexible hose, to a vacuum source such as a vacuum cleaner or a hot water extractor. However, when vacuum cleaning or hot water extraction cleaning of carpeted stairs, it is difficult to adequately vacuum the inside corner (where the carpet transitions from the horizontal step to the vertical riser) and the outside corner (where the carpet transitions from the vertical riser to the horizontal step) because of the typical long straight suction inlet of the nozzle.

Further such straight suction inlets do not adequately accommodate the many irregular curves found in upholstered furniture.

The present invention is intended to overcome the inherent problems discussed above in a novel manner.

SUMMARY OF THE INVENTION

In accord with the invention disclosed and taught herein, a unique and novel accessory for converting the straight line suction inlet of the typical hand held suction nozzle into a convex or concave suction inlet is disclosed and taught.

Broadly, there is disclosed herein a suction nozzle adapter, that is frictionally retained within the straight line suction nozzle inlet and having an extended suction inlet of a convex, concave, or other arcuate shape. In the embodiment as illustrated herein teaches a convex suction inlet configured to approximate the inside corner radius of carpeted stairs and a concave suction inlet configured to approximate the outside curve of carpeted stairs.

In the preferred embodiment of the invention, separate suction inlet adapters are taught for the convex and concave configurations and each includes means for preventing over sprayed fluid from dripping onto the horizontal step when used with a typical hand held hot water extractor nozzle. However, an embodiment having both a convex and concave suction inlet is also disclosed.

Although the preferred embodiments taught herein relate to hand held carpet and upholstery extractor nozzles attached to a flexible suction hose, the invention as disclosed herein may also be adapted, by those skilled in the art and without inventive input, for use with a typical dry hand held vacuum cleaner or any other vacuuming nozzle, and is particularly useful for vacuuming household and/or automotive upholstery and carpets where curved surfaces exist.

DETAILED DESCRIPTION OF THE INVENTION

Figure 1:
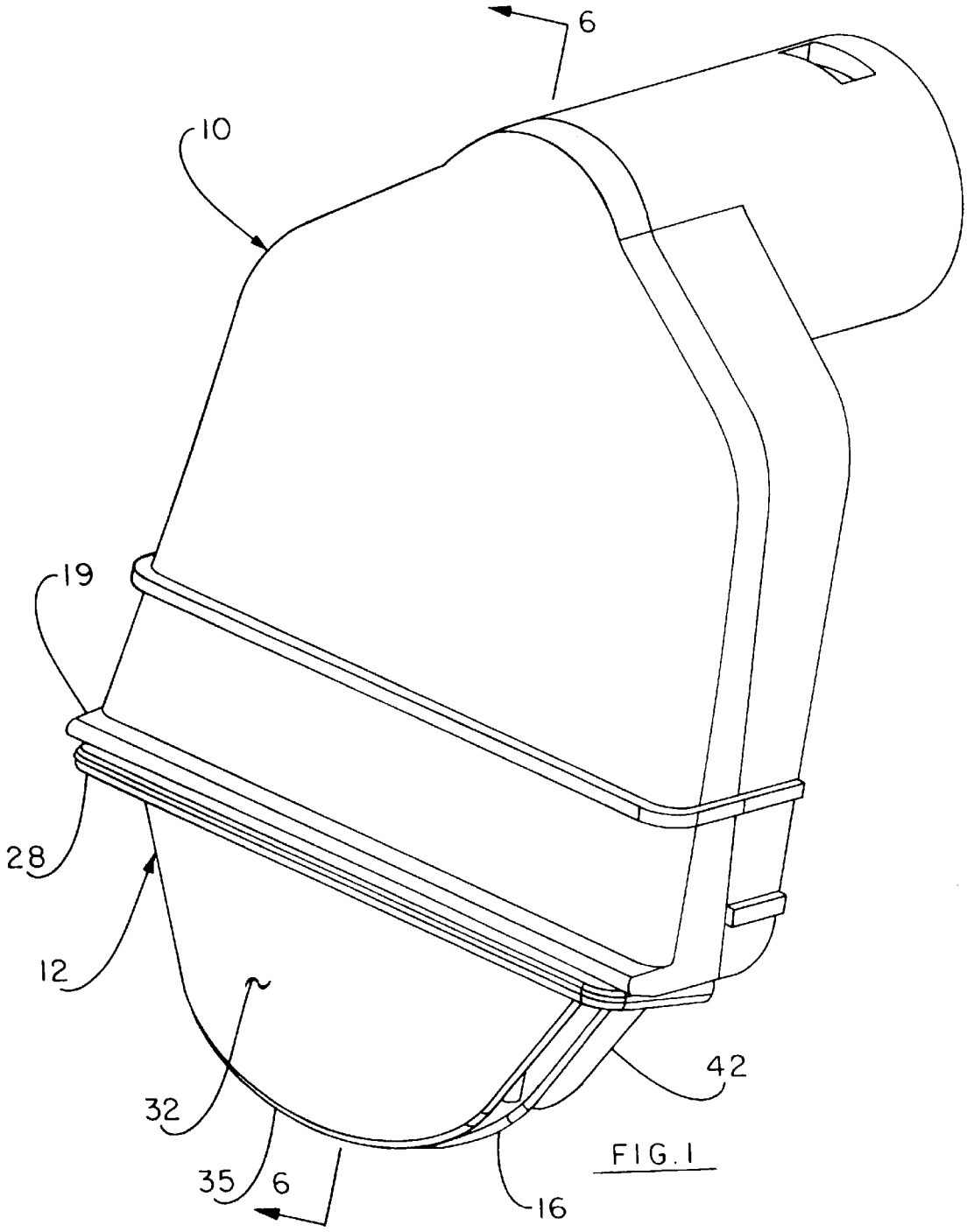
FIG. 1 presents a front pictorial view of a typical hand held vacuuming nozzle having our convex adapter attached thereto.
Figure 2:
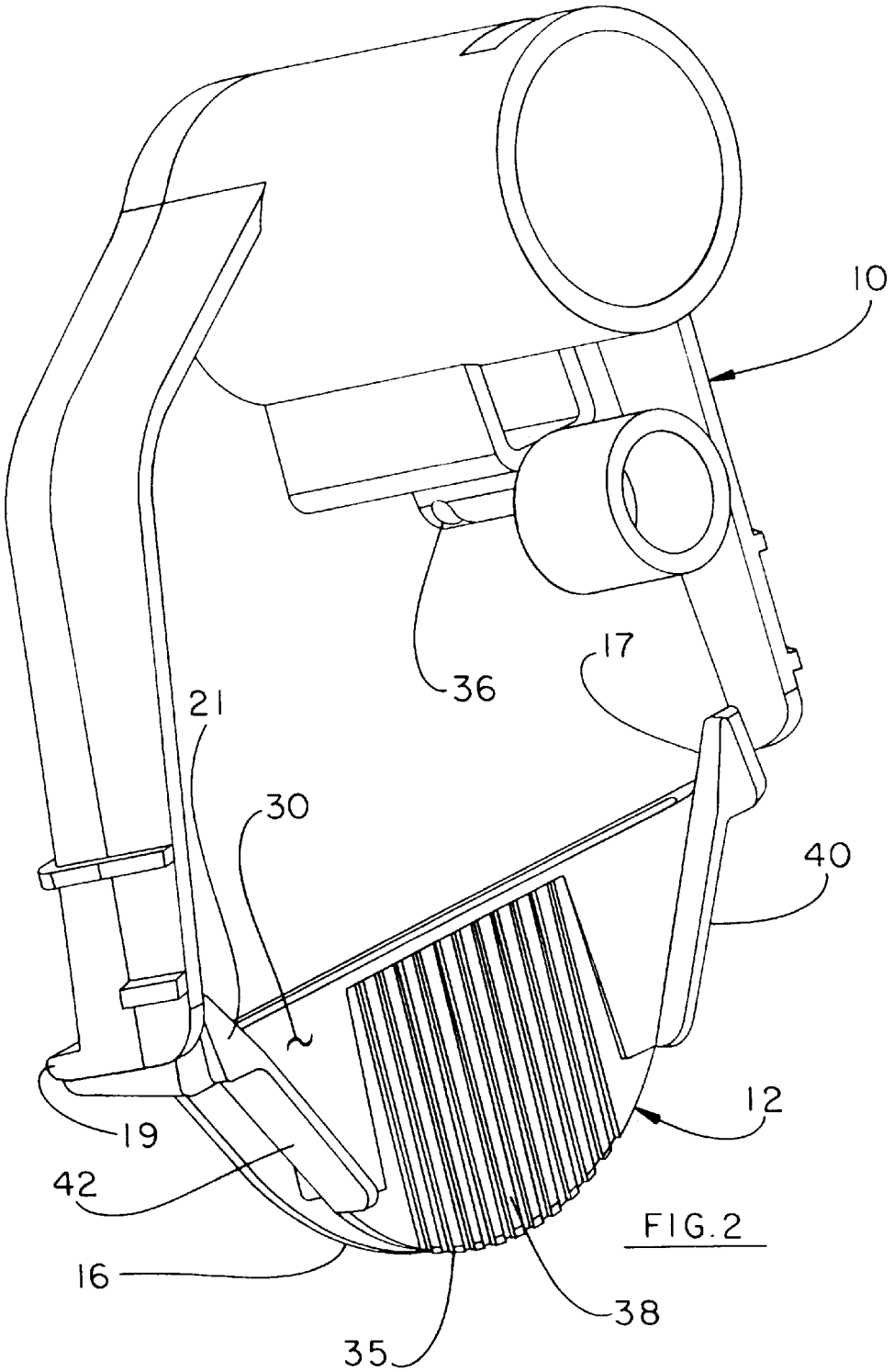
FIG. 2 presents a rear pictorial view of a typical hand held vacuuming nozzle having our convex adapter attached thereto.
Figure 3:
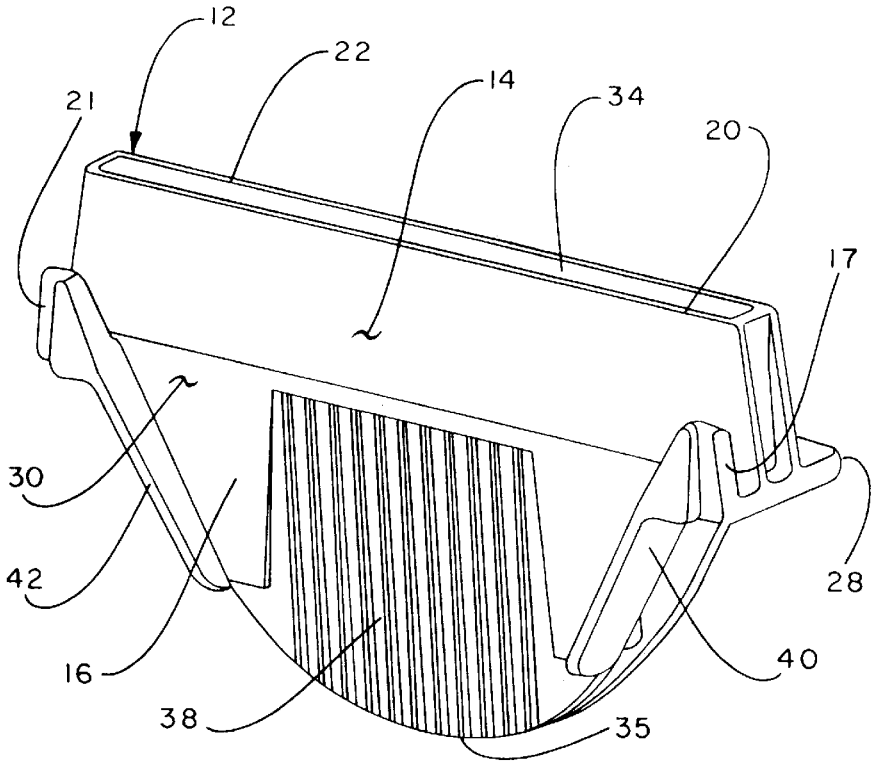
FIG. 3 presents a rear pictorial view of our convex adapter separate and apart from the nozzle.
Figures 5, 6:
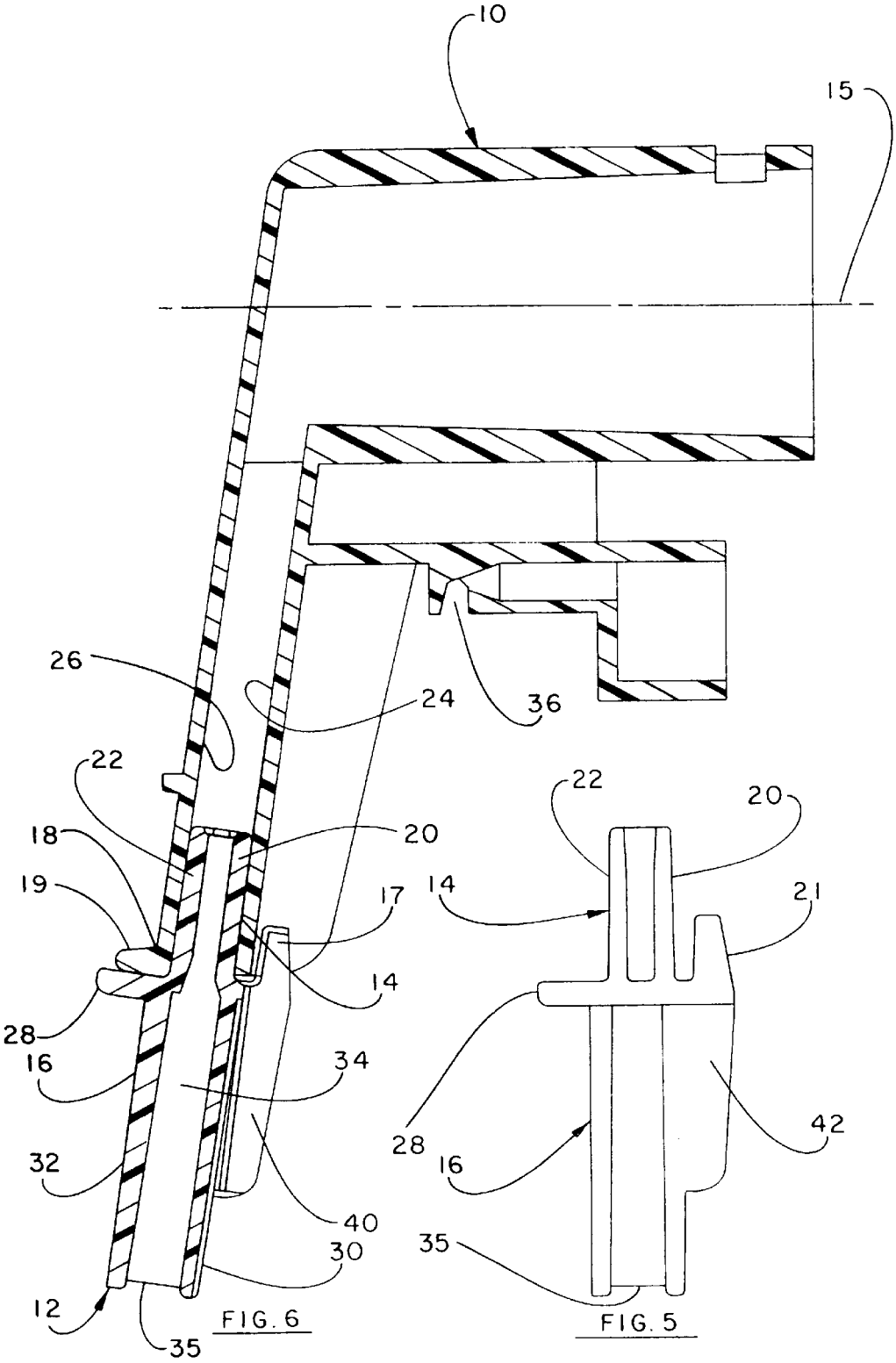
FIG. 5 presents a left side elevational view of our convex adapter.
FIG. 6 presents a cross-sectional view taken along line 6—6 of FIG. 1.

FIGS. 1 and 2 show front and rear perspective views, respectively, of a typical hand held hot water extractor vacuum nozzle 10 having our convex nozzle adapter 12 inserted therein. FIG. 3 presents a rear perspective view of convex adapter 12 separate and apart from nozzle 10. As seen in FIGS. 3, 4, 5, and 6, convex adapter 12 has an upper nozzle engaging portion 14 and a lower suction inlet portion 16. When in use the upper portion 14 of convex adapter 12 is inserted into the suction inlet 18 of nozzle 10 and held in place by the frictional engagement of front and rear walls 22 and 20 of adapter 12 with the inside walls 26 and 24 of nozzle 10 respectively as illustrated in FIG. 6. A forwardly extending lip 28, on adapter 12, is in abutting contact with the forwardly extending ledge 19 of nozzle 10 whereby the clockwise moment, as viewed in FIG. 6, acting upon adapter 12 when translated to the right, during use, is partly resisted. When translated to the left the counterclockwise moment imparted to adapter 12 is partly resisted by tabs 17 and 21. The upper portion 14 inserted into nozzle 10 also acts to resist the above described moments.

Figures 7, 7A, 13:
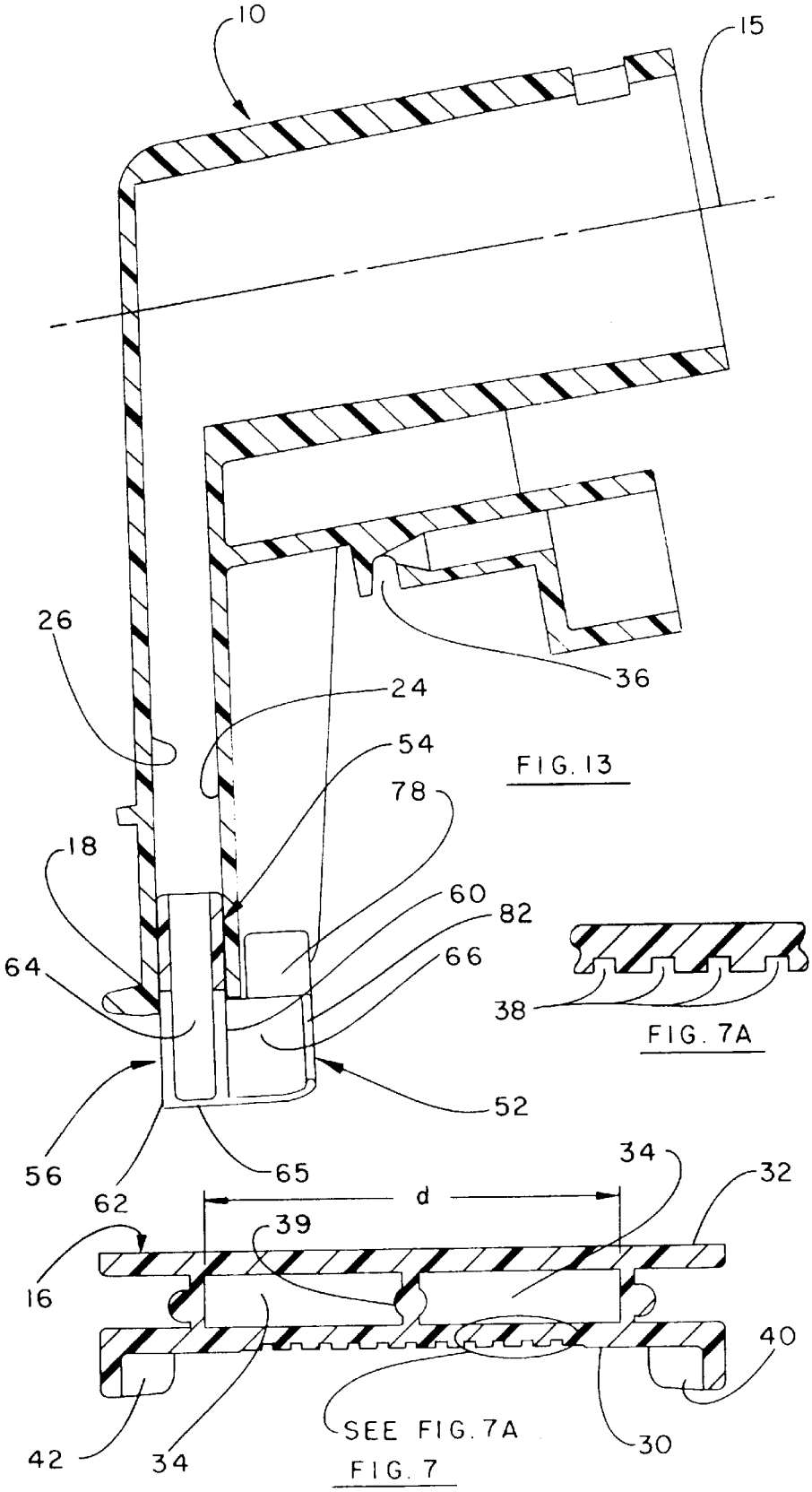
FIG. 7 presents a cross-sectional view taken along line 7—7 of FIG. 4.
FIG. 7A presents an enlarged view of the encircled area of FIG. 7.
FIG. 13 presents a cross-sectional view taken along line 13—13 of FIG. 9.

As seen in FIGS. 6 and 7, adapter 12 basically comprises two generally parallel plates or walls 30 and 32, sealed on the ends, thereby forming a rectangular suction conduit 34 therebetween. Conduit 34 may be divided by a reinforcing gusset 39 as shown in FIG. 7 or it may be left undivided if desired. As may be seen in FIG. 8, the suction inlet 35 of convex adapter 12 is configured with a convex curve approximating the inside curve generally existing, on carpeted stairs, as the carpet transitions from the horizontal step 33 to the vertical riser 31.

Figure 8:
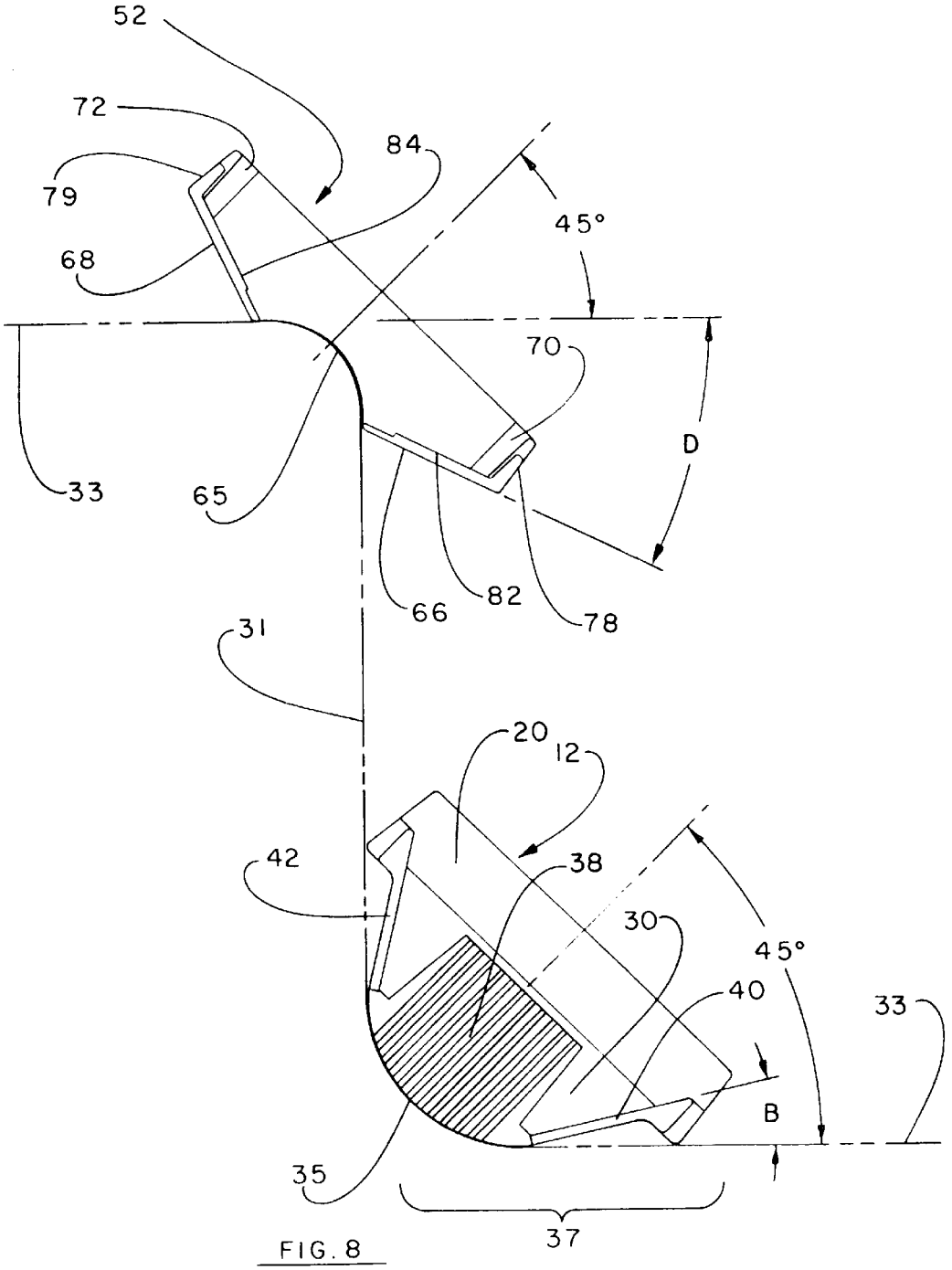
FIG. 8 is an illustration of our convex and concave adapters as used to vacuum the inside and outside corners of a carpeted stairway, the associated vacuuming nozzle being removed for clarity.

When convex adapter 12 is used for cleaning stairs with a typical hand held hot water extractor type nozzle, as shown in FIGS. 1, 2 and 6, the assembly is generally inclined approximately 45° as shown in FIG. 8 (lower portion). A portion of the hot water spray from jet 36 (see FIG. 6) may be expected to impinge upon the rear wall 30 of convex adapter 12, particularly where the spray pattern, from jet 36, is intended to alight upon the normally vacuumed horizontal surface immediately behind suction inlet 18. The impinging spray upon rear wall 30 may be expected to gravitationally run downward from the adapter thereby wetting a portion 37 of the horizontal step 33 below. To prevent this otherwise misdirected flow of impinging fluid, upon the rear surface 30 of adapter 12, from dripping onto and wetting the horizontal step 33, an array of side by side grooves 38 (as best shown in FIGS. 4, 7, and 7A) are provided within the surface of rear wall 30 to catch the overspray and direct it toward suction inlet 35.

Since the width of the fluid spray pattern emanating from spray jet 36 typically expands to the approximate width of nozzle 10, overspray will also occur and impinge upon rear wall 30 below and to the right of grooves 38 as viewed in FIG. 8. A pair of inclined strakes 40 and 42 are provided to catch and collect the widthwise overspray not otherwise caught by grooves 38 and direct it toward the suction inlet 35 of adapter 12 thereby preventing it from dripping downward upon the step surface 33.

Figure 4:
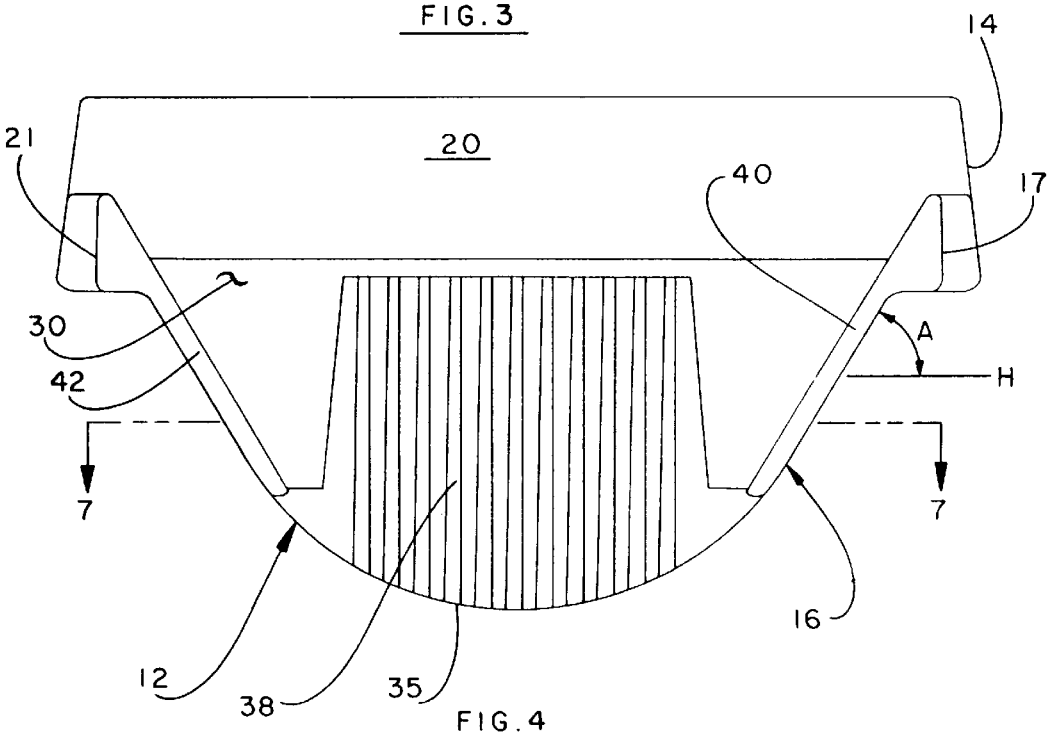
FIG. 4 presents a rear elevational view of our convex adapter.

It is preferred that strakes 40 and 42 be inclined approximately 60° with respect to the horizontal H (see angle A in FIG. 4). Thus when adapter 12 (attached to nozzle 10) is inclined 45° (as shown in FIG. 8) the lower strake 40 (as shown in FIG. 8) remains at an inclination angle B of approximately 15°. Thus fluid draining downward onto strake 40 from rear wall 30, of adapter 12, will flow along inclined strake 40 and be drawn into suction inlet 35. Although strakes 40 and 42 are shown as being perpendicular to rear wall 30, strakes 40 and 42 may also be angularly directed upward or possibly have a concave trough like channel to prevent the flow of fluid over the edge thereof.

Figure 9:
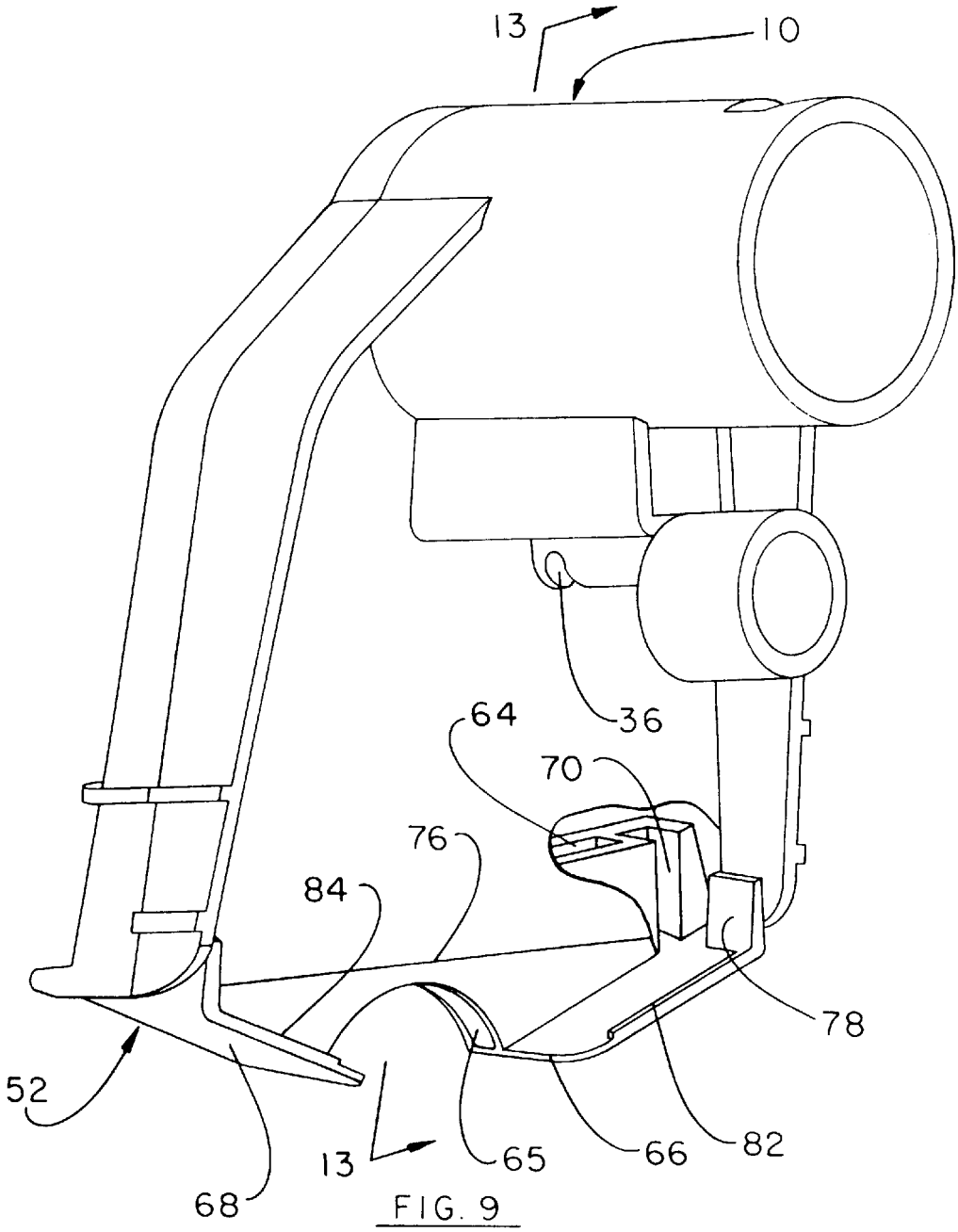
FIG. 9 presents a rear pictorial view of a hand held vacuuming nozzle having our concave adapter attached thereto.
Figure 10:
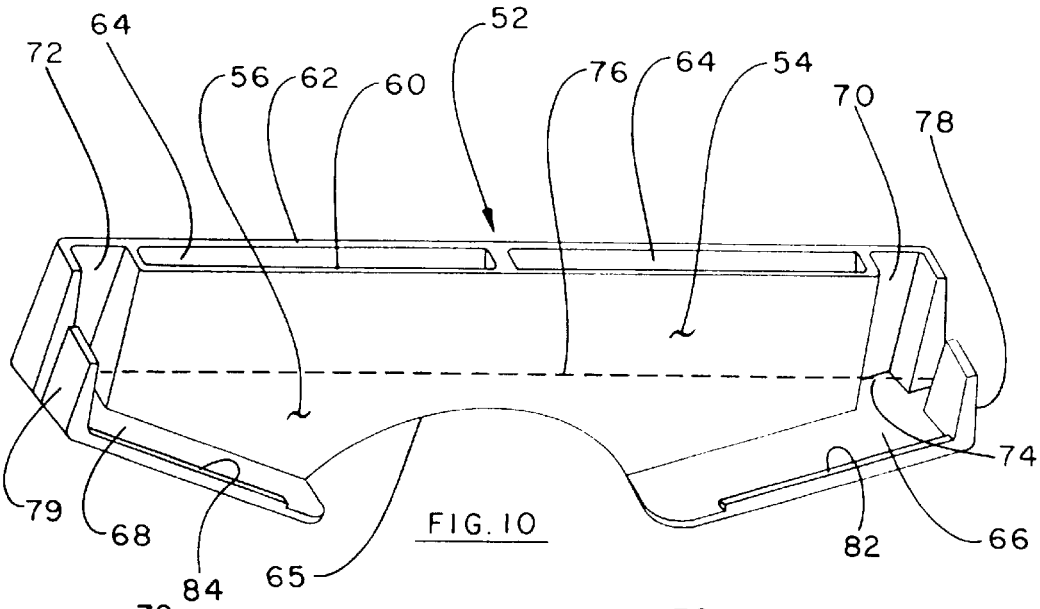
FIG. 10 presents a rear pictorial view of our concave adapter separate and apart from the nozzle.

FIG. 9 shows a rear perspective view of vacuum cleaning nozzle 10 with our concave nozzle adapter 52 inserted therein. FIG. 10 presents a rear perspective view of concave adapter 52 separate and apart from nozzle 10. As seen in FIGS. 9, 10, 11, and 13, concave adapter 52 has an upper nozzle engaging portion 54 (that portion above the dotted line in FIGS. 10 and 11) and a suction inlet section 56 (that portion below the dotted line in FIGS. 10 and 11). When in use the upper portion 54 of concave adapter 52, is inserted into the suction inlet 18 of nozzle 10 and is held in place by the frictional engagement of walls.60 and 62 of adapter 52 with the inside walls 24 and 26 of nozzle 10, respectively.

As shown in FIGS. 9, 10, and 13 concave adapter 52, similar to convex adapter 12, basically comprises two generally parallel plates or walls 60 and 62 sealed on the ends, thereby forming a rectangular suction channel 64 therebetween. Similar to adapter 12 channel 64 may be divided with a reinforcing gusset. As may be seen in FIG. 8 (top portion), the suction inlet 65 of adapter 52 is configured with a concave curve preferably approximating the outside curve generally existing on carpeted stairs as the carpet transitions from the vertical riser 31 to the horizontal step 33.

Figure 11:
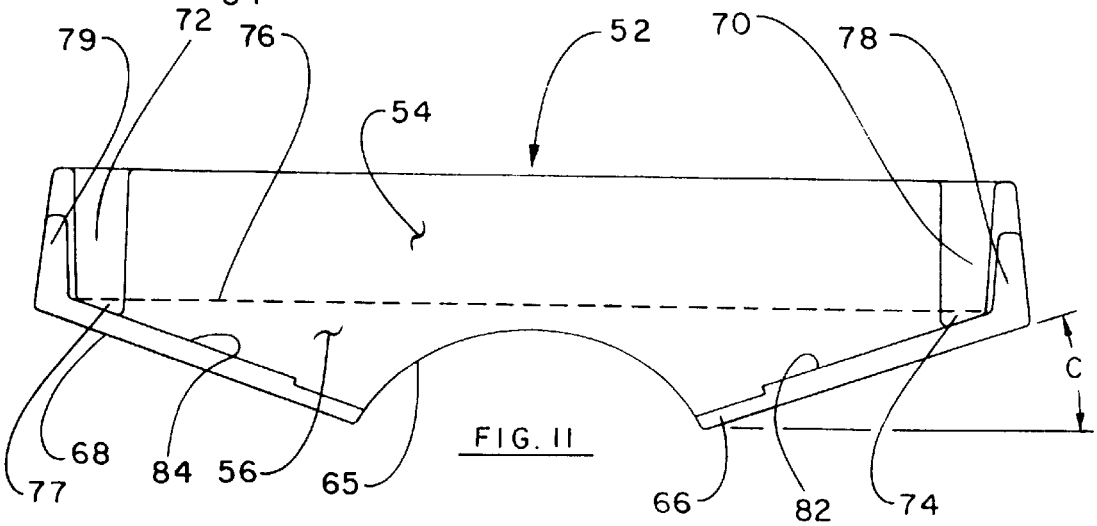
FIG. 11 presents a rear elevational view of our concave adapter.
Figure 12:
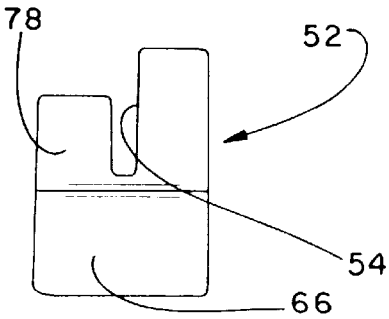
FIG. 12 presents a right side elevational view of our concave adapter.

When the concave adapter 52 is used for stairs cleaning with a typical hand held hot water extractor type nozzle 10, as shown in FIGS. 9 and 13, the assembly is generally inclined 45° as shown in FIG. 8. Similar to convex adapter 12 a portion of the hot water spray from jet 36 may be expected to impinge upon the rear wall 60 of concave adapter 52. Similar to the situation with convex adapter 12 described above, impinging spray upon rear wall 60 may be expected to gravitationally run downward from the adapter thereby wetting the horizontal step below. To prevent this otherwise misdirected flow of impinging fluid from wetting the step below, strakes 66 and 68 (similar to strakes 40 and 42 on convex adapter 12) are provided to collect the fluid run off from rear wall 60. Strakes 66 and 68 are preferably slanted approximately 20°, angle C in FIG. 11, below the horizontal. However, when nozzle 10, with adapter 52 attached thereto, is inclined at the 45° working angle, as seen in FIG. 8, the lower strake 66 is inclined approximately 25°, angle D, below the horizontal. Thus accumulated fluid will flow away from suction inlet 65 of adapter 52. To reclaim the fluid run off, recessed channels 70 and 72 (see FIGS. 9, 10, and 11) are provided at each end of adapter 52. When adapter 52 is inserted into nozzle 10. Channels 70 and 72 cooperate with the inside wall 24 of nozzle 10 to form open ended suction conduits. As seen in FIG. 11, a small triangular opening 74 is formed between the inclined strake 66 and the rearward lip of nozzle 10, as indicated by the broken line 76. The accumulated fluid flowing along strake 66 is blocked by end wall 78 (or 79 when inclined in the opposite direction) and drawn into triangular opening 74 by action of the suction communicated to opening 74 through channel 70 from suction nozzle 10. A similar triangular opening 77 exists at the opposite end of adapter 52 which similarly reclaims fluid when the adapter is tilted in the opposite direction.

To prevent accumulated fluid from flowing over the edge of strakes 66 and 68, a slightly raised elongated barrier or flow fence 82 and 84 is provided along the strake edge. Although no similar flow fence is shown on adapter 12, a flow fence may also be added to strakes 40 and 42 if desired. Similar to convex adapter 12, strakes 66 and 68 may also be inclined upwards or provided with a concave trough to prevent accumulated fluid from spilling over the edge.

Alternatively rear wall 60 may be extended the full width of adapter 52, similar to front wall 62, with an appropriately positioned opening (or possibly a family of openings) extending through rear wall 60 at the intersection of wall 60 with strakes 66 and/or 68 thereby providing a flow path for liquid accumulating upon strake 66 or 68 into suction channel 64.

Figure 14:
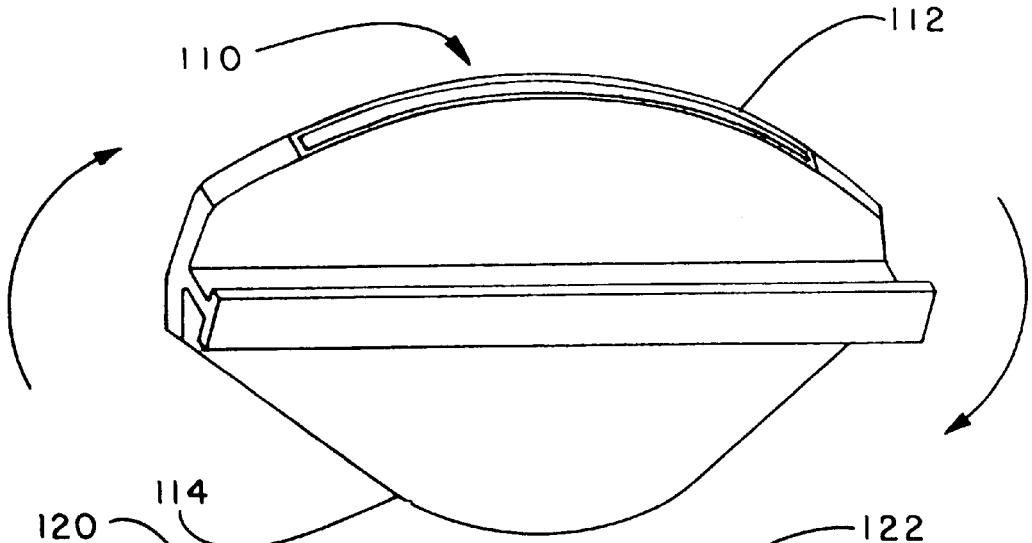
FIG. 14 presents a pictorial view of an alternate embodiment of a convex adapter with reversible and opposing suction inlets having different inlet convexity.
Figure 15:
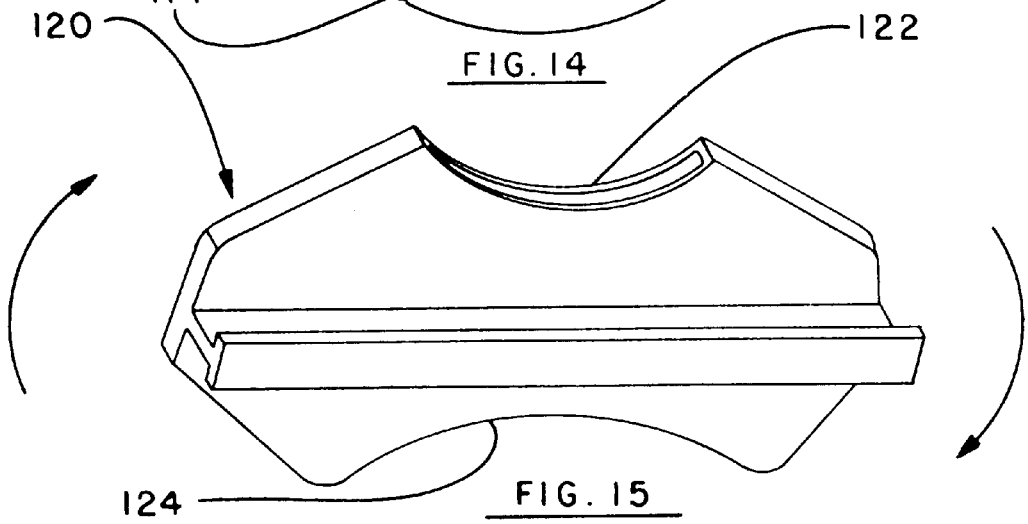
FIG. 15 presents a pictorial view of an alternate embodiment of a concave adapter with reversible and opposing concave suction inlets having different inlet concavity.
Figure 16:
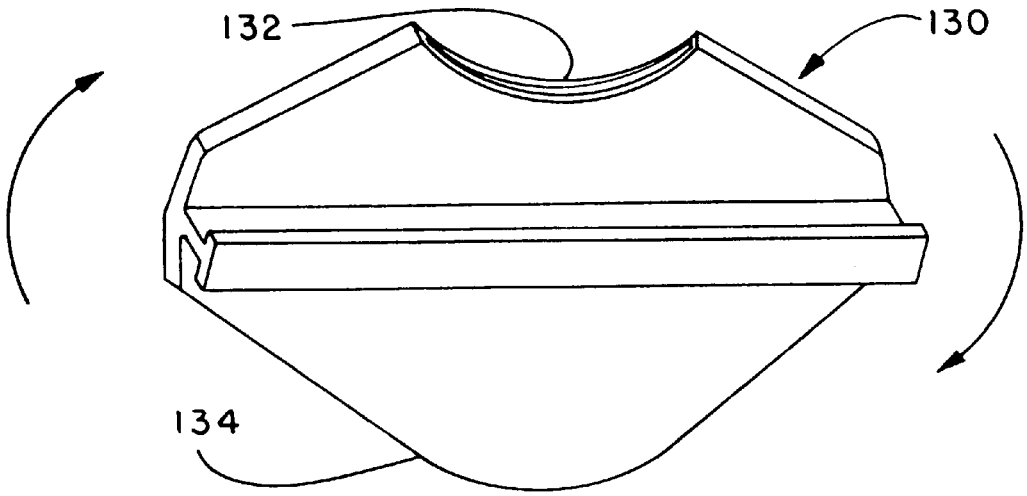
FIG. 16 presents a pictorial view of an alternate embodiment concave/convex adapter with reversible and opposing convex and concave suction inlets.

FIGS. 14, 15, and 16 show alternate embodiments of suction nozzle adapters. All three embodiments shown are constructed, similarly to the adapters described above, comprising two generally parallel plates or walls, closed at each side thereby forming a suction conduit of rectangular cross-section therebetween. As with adapters 12 and 52, described above, adapters 110,120, and 130, frictionally slide inside a hand held suction nozzle such as nozzle 10. However, adapters 110, 120, and 130 may be reversed (rotated 180° as indicated by the arrows) so that either of the two opposing suction inlet profiles may be used to vacuum a contoured surface. Either end of adapters 110, 120, and 130 may be inserted into nozzle 10 being retained therein by frictional engagement with the inside walls of suction nozzle 10.

Adapter 110 is provided with two opposing convex suction inlets 112 and 114 having differing convex profiles. Adapter 120 is provided with two opposing concave suction inlets 122 and 124 having differing concave profiles. Adapter 130 is provided with convex suction inlet 134 and opposing concave suction inlet 132.

Figure 17:
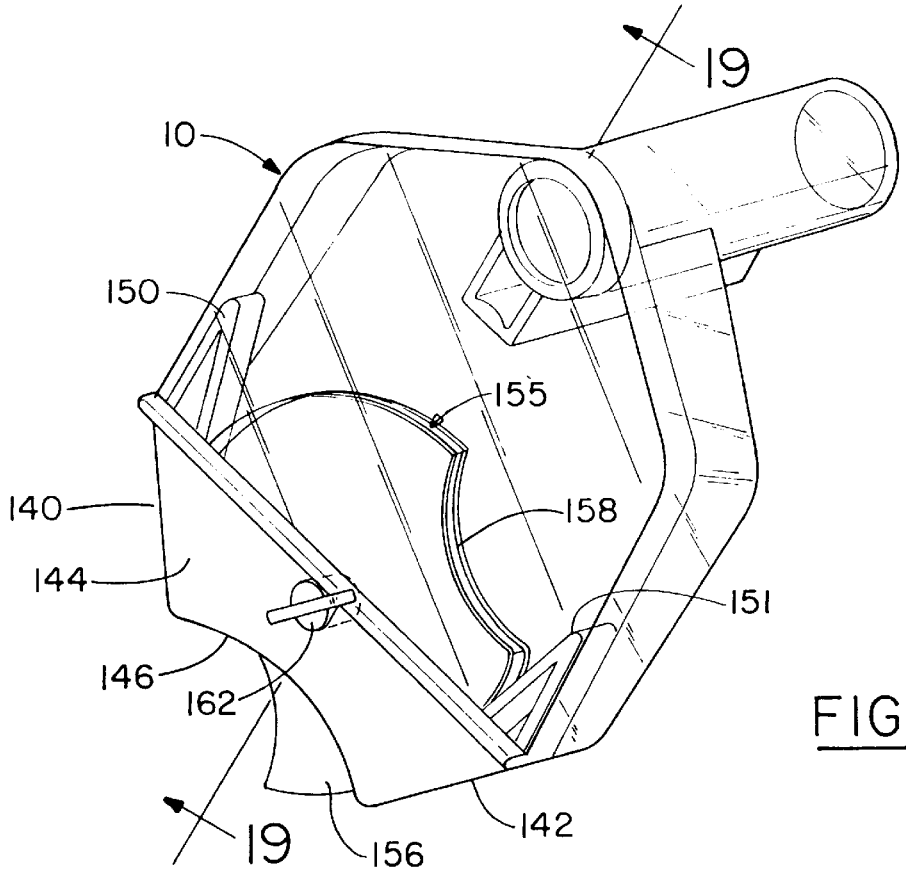
FIG. 17 presents a pictorial view of another alternate embodiment of our invention.
Figure 19:
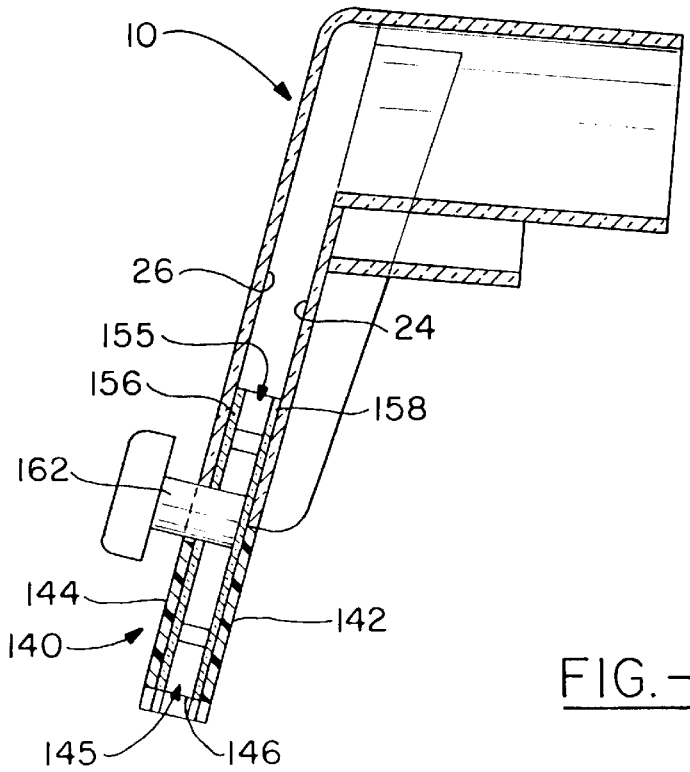
FIG. 19 is a cross-sectional view taken along line 19—19 in FIG. 17.
Figure 18:
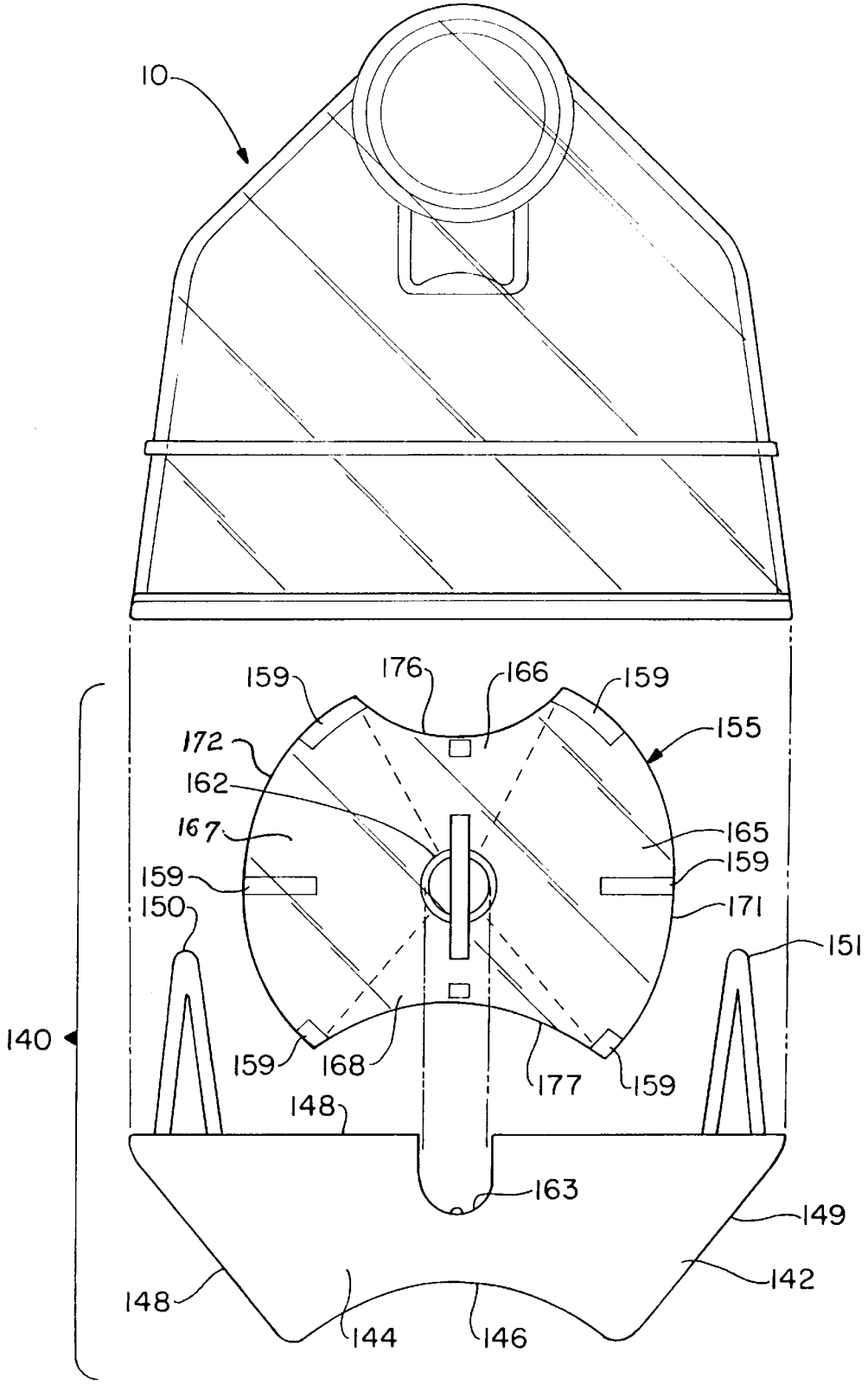
FIG. 18 presents an exploded view of the principal elements comprising the embodiment illustrated in FIG. 17.

Referring now to FIGS. 17 through 19, a further embodiment of our invention is illustrated. Nozzle 10 is fitted with a removable suction inlet adapter 140. Adapter 140 comprises a main body 142 generally having a pair of parallel side walls 144 and 146 closed-off at the ends thereof 148 and 149 forming an elongate, rectangular suction inlet 145 therebetween and defining an inlet end 146 and an exit end 148. The inlet end 146 is configured to form a concave suction inlet similar to that as illustrated in FIGS. 10 and 11. Projecting outward from the exit end 148 are two spacers 150 and 151 which are frictionally received within the inside walls 24 and 26 of nozzle 10 as illustrated in FIG. 17.

Received within the adapter main body 142 is rotor assembly 155 generally comprising two parallel, spaced apart walls 156 and 158 having spacers 159 therebetween. Rotor 155 is supported within the adapter main body 142 by axle shaft 162 rotatingly received within journal 163. Rotor assembly 155 includes four zones or sectors 165, 166, 167, and 168 as best illustrated in FIG. 18. The outer periphery of sectors 165 and 167 are provided with convex curves of varying radii or profiles 171 and 172. The outer periphery of sectors 166 and 168 are provided varying concave profiles 176 and 177.

By selectively rotating rotor assembly 155, the operator may select which suction inlet profile, 165, 166, 167, or 168 is desirable for vacuuming a particular surface.

Although the present invention has been described in connection with a preferred embodiment thereof, many variations and modifications will become apparent to those skilled in the art. It is preferred, therefore, that the present invention be limited not by the specific disclosure herein, but only by the appended claims.

We claim:

1. An adapter for converting a laterally extending straight line suction inlet of a vacuum cleaner nozzle to a convex suction inlet having a laterally extending convex configuration, said adapter comprising a nozzle attachment portion and a suction inlet portion wherein said nozzle attachment portion includes means for removably attaching said adapter to said straight line suction inlet and said suction inlet portion comprising spaced apart front and rear walls integral with and extending away from said nozzle attachment portion, said front and rear walls being connected by side walls defining an open ended fluid flow conduit therebetween, said conduit fluidly communicating with said straight line suction inlet at one end thereof and defining at the opposite end thereof a convex suction inlet having a laterally extending convex configuration and;

an opposing pair of strakes, each projecting rearward from the rear wall of said suction inlet portion of said adapter and extending from said nozzle attachment portion to said convex suction inlet, each of said strakes being angularly inclined with respect to a plane extending laterally across said adapter and converging toward said convex suction inlet.

2. The nozzle adapter as claimed in claim 1 wherein said rear wall of said suction inlet portion includes a multiplicity of grooves extending from a boundary between said nozzle attachment portion and said suction inlet portion to the convex suction inlet, said grooves being located between said strakes.

3. The nozzle adapter as claimed in claim 1, wherein said strakes are inclined with respect to said laterally extending plane at angles of about 60 degrees.

4. An adapter for converting a laterally extending straight line suction inlet of a vacuum cleaner to a concave suction inlet having a laterally extending concave configuration, said adapter comprising a nozzle attachment portion and a suction inlet portion wherein said nozzle attachment portion includes means for removably attaching said adapter to said straight line suction inlet and said suction inlet portion comprising spaced apart front and rear walls integral with and extending away from said nozzle attachment portion, said front and rear walls being connected by side walls defining an open ended fluid flow conduit therebetween, said conduit fluidly communicating with said straight line suction inlet at one end thereof and defining, at the opposite end thereof, a concave suction inlet having a laterally extending concave configuration and;

an opposing pair of strakes, each projecting rearward from the rear wall of said suction inlet portion of said adapter and extending from said nozzle attachment portion to said concave suction inlet, each of said strakes being angularly inclined with respect to a plane extending laterally across the adapter and converging toward said concave suction inlet.

5. The nozzle adapter as claimed in claim 4, including means for drawing accumulated fluid from said strakes into said straight line suction inlet.

6. The nozzle adapter as claimed in claim 5, wherein said straight line suction inlet has a length and a width, said front wall extends substantially the full length of said straight line suction inlet and said rear wall extends a portion of the length of said straight line suction inlet thereby defining at least one recessed channel in said suction inlet portion, said channel extending from at least one of said strakes to said straight line suction inlet thereby defining said means for drawing accumulated fluid from said strakes.

7. The nozzle adapter as claimed in claim 5, wherein said means for drawing accumulated fluid from said strakes comprises openings passing through said rear wall of said suction inlet portion, adjacent said strakes, into communication with said fluid flow conduit.

8. The nozzle adapter as claimed in claim 5, including a pair of end walls, one of said end walls extending at an angle from an end of each said strake, to prevent fluid accumulated on said strakes from running off the ends of said strakes.

9. The nozzle adapter as claimed in claim 4, wherein said strakes are inclined with respect to said laterally extending plane at angles of about 20 degrees.

10. An adapter, for selectively adapting an extractor suction nozzle having an elongate laterally extending straight line suction inlet and a spray means for spraying cleaning solution adjacent the suction inlet into an extractor suction nozzle having an elongate laterally extending arcuate suction inlet, said adapter comprising:

a hollow body having generally parallel front and rear walls joined by edge walls and opposing first and second open ends, the first open end defining an outlet and having means for the adapter to such a laterally extending straight line suction inlet of an extractor suction nozzle with the outlet in communication with the straight line suction inlet, the second of the adapter terminating in a laterally extending arcuate suction inlet approximating a surface contour to be cleaned; and spray directing means is located on an outer surface of the rear wall of the adapter for, when the adapter is connected to such an extractor suction nozzle, directing cleaning solution sprayed from the spray means to the curved suction inlet; and wherein the spray directing means comprises a plurality of grooves in the outer surface of the rear side of adapter that extend from an area between the first and second ends to the curved suction inlet.

11. An adapter according to claim 10, wherein the second end of the adapter terminates in a laterally extending convex suction inlet.

12. An adapter according to claim 10, wherein the second end of the adapter terminates in a laterally extending concave suction inlet.

13. An adapter according to claim 12, wherein the spray directing means further comprises strakes extending out from the rear side of the adapter adjacent the second end of the adapter, the strakes converge toward the curved suction inlet.

14. An adapter according to claim 10, wherein the front and rear walls are continuous, uninterrupted walls.

* * * * *